US005785512A

United States Patent [19]

Cormier

[11] Patent Number: 5,785,512

[45] Date of Patent: Jul. 28, 1998

[54] INFRARED EMITTANCE COMBUSTION ANALYZER

[75] Inventor: Kenneth C. Cormier, Dallas, Tex.

[73] Assignee: Fireye, Inc., Derry, N.H.

[21] Appl. No.: 768,199

[22] Filed: Dec. 17, 1996

[51] Int. Cl.[6] ..... F23N 5/08

[52] U.S. Cl. ..... 431/79; 431/12; 431/75; 340/578

[58] Field of Search ..... 431/9, 10, 12, 431/14, 75, 76, 79, 90; 340/578; 250/339

[56] References Cited

U.S. PATENT DOCUMENTS

| | | | |
|---|---|---|---|
| 2,840,146 | 6/1958 | Ray | 431/79 |
| 3,716,717 | 2/1973 | Scheidweiler et al. . | |
| 3,940,753 | 2/1976 | Muller . | |
| 4,043,742 | 8/1977 | Egan et al. . | |
| 4,179,606 | 12/1979 | Nakauchi et al. . | |
| 4,435,149 | 3/1984 | Astheimer . | |
| 4,486,166 | 12/1984 | Nelson et al. . | |
| 4,785,292 | 11/1988 | Kern et al. . | |
| 4,830,601 | 5/1989 | Dahlander et al. . | |
| 4,913,647 | 4/1990 | Bonne et al. . | |

OTHER PUBLICATIONS

*Journal of the Institute of Fuel*, Jun. 1975, article entitled "Fuel: air ratio control using infra-red spectroscopy," A. Smith, PhD, J. Swithenbank, BSc, PhD, SInstF, MAmInstChE, & D. S. Taylor, MA.

*International Journal of OptoElectronics*, 1988, vol. 3, No. 5, 423–431, Article entitled "Fibre-optic spectral flame analysis for the control of combustion processes," P.K. Chau et al.

J. Spacecraft, vol. 3, Engineering Notes, Feb. 1960?, Article entitled "A Control Device for Supersonic Combustion Utilizing Spectral Intensity Ratio," Allen E. Fuhs, University of Colorado, Boulder, Colorado, pp. 269 & 270.

*Primary Examiner*—James C. Yeung

*Attorney, Agent, or Firm*—Leydig, Voit & Mayer, Ltd.

[57] ABSTRACT

An infrared emittance combustion analyzer utilizing detectors in a flame burner which monitor the radiation at two preselected wavelengths. The respective radiation signals are filtered to eliminate DC signal variations, rectified and converted into a DC value which is representative of the measured radiation signals. The respective DC values are formed into a ratio which is compared against a predetermined setpoint signal, and the error signal resulting from this comparison is utilized to drive an electromechanical controller which adjusts either the air damper or the fuel damper to adjust the fuel/air mixture which is fed into the burner.

5 Claims, 2 Drawing Sheets

INFRARED EMITTANCE COMBUSTION ANALYZER

BACKGROUND OF THE INVENTION

The present invention relates to a system and apparatus for flame detection for the purpose of monitoring and controlling the efficiency of the burning process. More particularly, the invention relates to an infrared emittance combustion analyzer for optimizing burning efficiency.

In the general field of control combustion apparatus and processes there are two categories by which the combustion process may be monitored and/or controlled. There is a process of flame detection which is primarily directed to equipment for monitoring the presence or absence of a flame, usually in the context of providing control safety devices. There is also the category of flame analysis, which is usually associated with burning efficiency processes.

The general category of flame analysis usually leads to one of two methods; the stack gas analysis, or the direct flame analysis. In the analysis of stack gases, the equipment and/or processes usually perform some sort of direct or indirect chemical analysis to determine the chemical constituents of the burning process. This is a relatively slow and analytical process and is unlikely to be used in connection with any real-time control over the combustion components for optimizing burning. The method of infrared absorption may also be used in connection with analysis of stack gases and may also be used in connection with the analysis of flames. This technique utilizes an infrared (IR) source and an IR sensor, wherein the source directs an IR signal across a medium to be measured and the sensor receives the transmitted IR to formulate a measurement of the concentration of the particular chemical being measured. When the medium is an exhaust gas, the IR source is mounted on one side of the exhaust gas stack and its IR radiation is directed across the stack to an IR detector which is responsive to a characteristic chemical wavelength. When the medium is a flame, a more powerful IR source such as a laser beam is used, but essentially the same approach is used as for the exhaust gas medium.

Maximum combustion efficiency occurs when air and fuel are mixed in exactly the right proportions. This is called stoichiometric combustion. Basically the reactants, oxygen and fuel make byproducts such as carbon dioxide and water. If there is too much of any one reactant, that reactant will end up going up the stack, thereby wasting energy. For example, if there is too much fuel the waste is in terms of lost chemical energy; if there is too much oxygen, the waste is in terms of thermal loss.

Many researchers have dealt with the problem of combustion efficiency, and the solution is usually had by analyzing the flue gases. Present-day technology usually relies on zirconium oxide sensors to analyze the percent of oxygen in the flue gas and/or infrared absorption analyzers that also analyze the stack gases. One of the problems with this approach is that measurement of stack gases only gives an average of how the burners are performing. In a multiple burner system, one burner could be fuel rich while another burner is air rich, and the average flue gas answer would be satisfactory even though both burners are burning inefficiently. Another problem with analyzers of the foregoing types, is that neither of them span the stoichiometric line; i.e., oxygen analyzers do not work in fuel-rich conditions, and carbon dioxide analyzers do not work in air-rich conditions. To provide a good combustion analysis, both CO and $O_2$ analyzers are required which add to the expense of the system.

The technique of infrared emittance is also used in connection with flame monitoring, in order to measure the reactants and byproducts of the combustion process. When non-symmetrical molecules; i.e., CO, $CO_2$, $H_2O$, etc. are formed as byproducts of the combustion process, or when reactants; i.e., $CH_4$, $C_3H_8$, are excited in the combustion process they each emit infrared energy. Each chemical emits its own unique wavelength. However, there is a problem with utilizing the technique of infrared chemical emittance in a boiler or furnace-like structure, in that there is an overwhelming black body or gray body IR radiation given off by the boiler or furnace, corresponding to the boiler's temperature. This black body radiation amounts to a signal-to-noise problem wherein the "signal" is the desired chemical IR emittance and the "noise" is the temperature of the boiler, which may be significantly greater than the "signal."

The IR radiation from the boiler is non-varying with respect to time, while the IR radiation from the chemicals is time-varying at some frequency. Therefore, the signal-to-noise problem may be solved by equipment design which operates in the frequency domain and does not utilize signals at the DC level.

SUMMARY OF THE INVENTION

The present invention relates to a system and apparatus for analysis of a flame through infrared (IR) emittance combustion analysis. The system is responsive to the radiation signals in the frequency domain at approximately 30 hertz (Hz), and is responsive to IR signals at two specific wavelengths. In the preferred embodiment the preselected wavelengths are 2.96 microns and 3.35 microns. The system forms the numerical ratio of the signals at the respective wavelengths, to provide a good indicator of combustion stoichiometry. The ratio of the two selected wavelengths increases linearly with increases in the percentage oxygen used in the burning process. For any given combustion circumstance, the system comprises a closed-loop circuit to relate either fuel or combustion air so as to maintain a fixed ratio.

It is the principal object of the present invention to provide a system for indicating combustion efficiency and for controlling the fuel/oxygen levels in a furnace or boiler apparatus.

It is another object of the present invention to provide a combustion indicator which optimizes the fuel/air mixture into a burner.

It is a further object of the present invention to provide a burner efficiency control mechanism for reducing the harmful byproducts of the combustion process.

The foregoing and other objects and advantages of the invention will become apparent from the following specification and claims and with reference to the appended drawings.

DESCRIPTION OF THE PREFERRED EMBODIMENT

Figure 1:
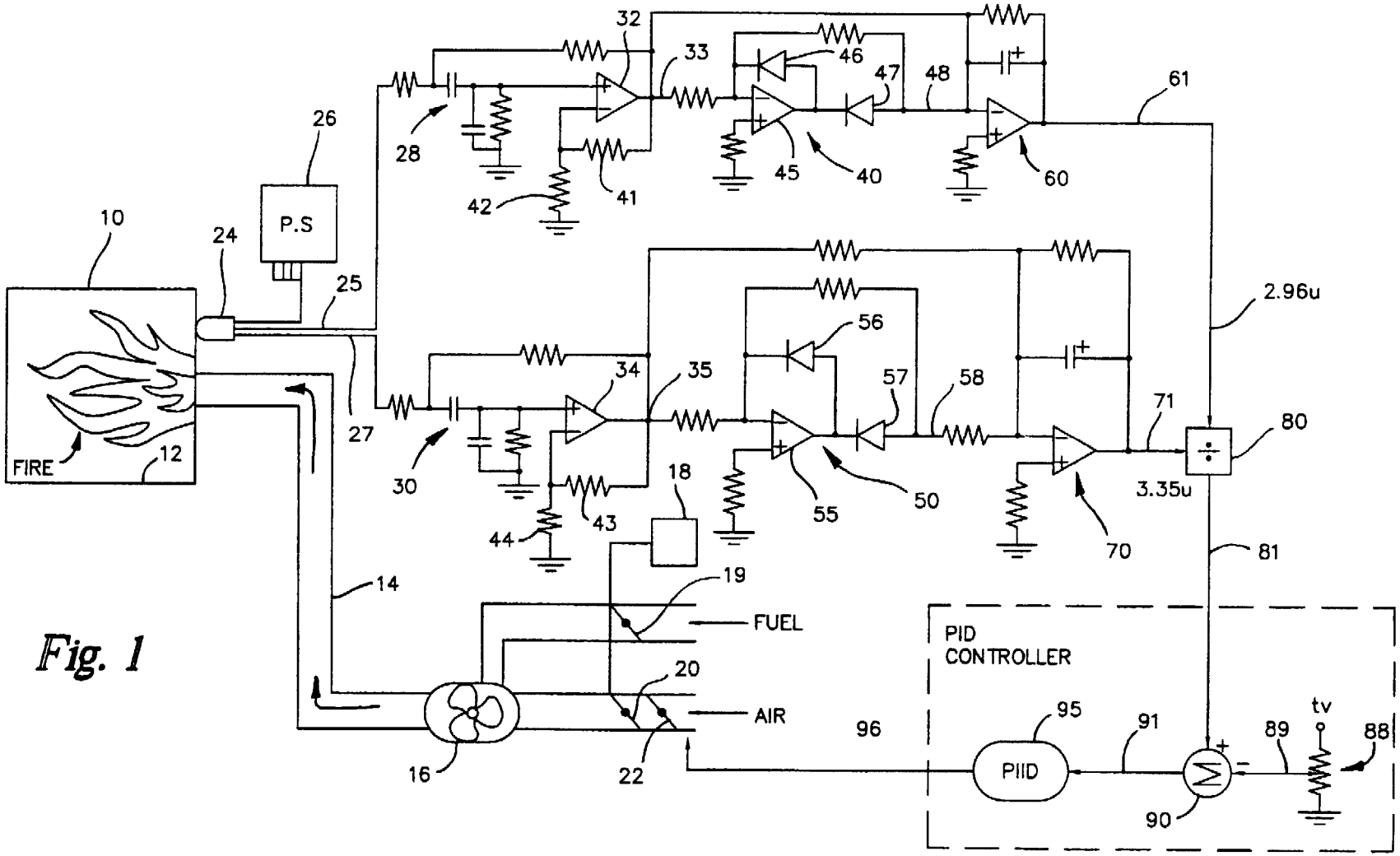
FIG. 1 shows a schematic and illustrative diagram of the invention.

Referring first to FIG. 1, there is shown a schematic and illustrative diagram of the apparatus of the present invention. A burner 10 is typically adapted for use in connection with a furnace or boiler operation. Burner 10 has a firebox 12 for the control burning of a fuel/air fire. The fuel/air mixture is fed into the firebox 12 via a fuel/air duct 14, and is fed by a blower 16 in the directions indicated by the arrows. Blower 16 receives fuel and air from respective feed lines, and the amount of fuel and air is controlled by a damper throttle control 18. Damper throttle control 18 simultaneously operates a fuel damper 19 and an air damper 20 to provide a predetermined fuel/air mixture into the firebox 12. A second air damper 22 is selectively adjusted by the control circuits to be hereinafter described. It should be noted that the invention could also be adapted to alternatively provide a second fuel damper for control purposes, but in the preferred embodiment the invention is described in connection with providing a second controllable air damper 22.

The firebox 12 is monitored by a detector 24 which, in the preferred embodiment, is a dual wavelength PbSe detector which has one sensor designed to be responsive to a first optical wavelength and a second sensor designed to be responsive to a second optical wavelength. In the preferred embodiment, the first sensor is responsive to wavelengths in the 2.96 micron band and the second sensor is responsive to wavelengths in the 3.35 micron band. These wavelengths are chosen for the reasons to be hereinafter described. Experimentation has shown that when the oxygen content fed into a burner is varied, there is a nearly linear variation of the corresponding 2.96 micron and 3.35 micron signals which may be observed from the burning process. As the oxygen content decreases, the 2.96 micron signal decreases linearly, while the 3.35 micron signal increases linearly. It should not be inferred that these signals are a measure of oxygen in the flame, but merely that they are proportional to the oxygen content. It is believed that these signals actually reflect some other chemical reaction in the combustion process; the 3.35 micron wavelength is most likely methane or propane C—H bond stretching, whereas the 2.96 micron wavelength is a well-known region where the water ($H_2O$) and carbon dioxide ($CO_2$) absorption lines overlap.

Experimentation has shown that signals at the respective wavelengths are relatively constant with increased and decreased intensity of the fire in a burner. At a constant fuel/air ratio, as the fuel/air injection increases, the burner flame becomes longer and moves deeper into the boiler. This effectively changes the axial sight point or distance along the flame, but does not appear to significantly change the respective wavelength measurement.

A power supply 26 provides the power for the circuitry described herein, including the power for operating detector 24. The detector 24 produces a signal on line 25 which is responsive to received wavelengths in the 2.96 micron band. Detector 24 produces a signal on line 27 which is responsive to light in the 3.35 micron band. The respective signals are fed through bandpass filters 28, 30 to respective amplifiers 32, 34. The circuit components for bandpass filters 28 and 30 are selected so as to pass all frequencies in the 30 hertz (Hz) band and to block DC voltage signals. Therefore, amplifiers 32 and 34 provide amplification only for the AC components of the received signals specifically at the 30 Hz frequency. The AC amplification factor of amplifier 32 is determined by the values selected for resistors 41, 42; the AC amplification factor of amplifier 34 is determined by selection of the component values of resistors 43, 44. The selection of these resistor values is well known in the art relating to amplifier design. The amplified signal output from amplifier 32 is conveyed via line 33 to a rectifier circuit 40. Rectifier circuit 40 includes an amplifier 45 and rectifier diodes 46, 47, in addition to selected resistor components. The output from this circuit appears on line 48 as a rectified AC signal which is proportional to the signal input via line 25. Similarly, the output from amplifier 34 is passed via line 35 to a rectifier circuit 50 which comprises amplifier 55, diodes 56, 57 and associated resistor components. The output signal from rectifier circuit 50 appears on line 58 and is proportional to the AC input signal received on line 27.

The rectified signal on line 48 is passed into an averaging circuit 60 which produces a steady state DC value on line 61 directly proportional to the input signal of line 25. Likewise, the rectified signal on line 58 passes into averaging circuit 70 which produces a steady state DC signal on line 71 which is directly proportional to the signal received on line 27.

It is, therefore, apparent that the steady state DC signal on line 61 is directly proportional to the received 2.96 micron wavelength signal, and the steady-state DC signal on line 71 is directly proportional to the received 3.35 micron wavelength. Both of these signals are coupled into a divisor circuit 80 which produces an output signal on line 81 which comprises the ratio of the two input signals. In particular, the output ratio signal on line 81 is formed of the ratio of the 2.96 micron signal to the 3.35 micron signal. The divisor circuit 80 and other similar circuits illustrated in the drawings can be equivalently replicated by a properly programmed commercially available micro controller. One example of a micro controller which is adequate for this purpose is manufactured by Intel, Type No. 80C196KC. This micro controller will produce an output signal representative of the ratio on line (or lines) 81. The ratio signal on line 81 is coupled to a summation circuit (representative as circuit 90) which itself may form a part of the same micro controller referred to above. Summation circuit 90 has a second input via line 89 which is connected to the center tap of a potentiometer 88, thereby providing a preselected DC signal value for presentation to summation circuit 90. The DC value on line 89 is preselected to represent the preferred ratio setpoint; i.e., the preferred oxygen percentage which is desired for the burner 10. Summation amplifier 90 actually forms the difference between the preselected DC signal on line 89 and the ratio signal on line 81, thereby forming a difference or error signal on output line 91.

The error signal on line 91 is presented as an input to a programmable controller 95 (PID) which may be programmably controlled to provide an analog or digital output drive signal via line 96 to mechanically adjust the position of air damper 22. The PID 95 may be the same micro controller as described above, operating under appropriate software control.

Figure 2:
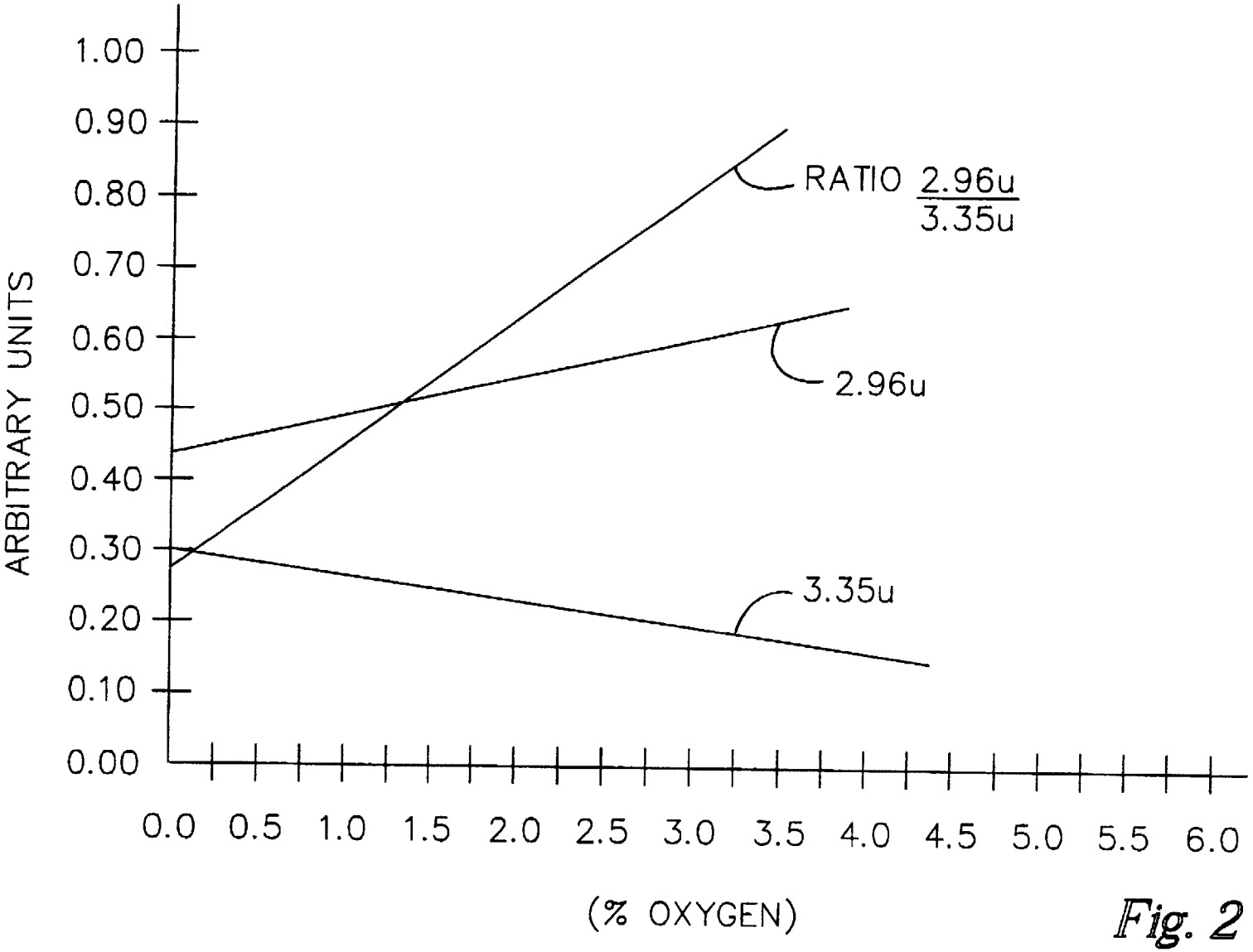
FIG. 2 shows a graphical representation.

FIG. 2 shows graphical plots of radiation signals measured as a function of arbitrary units versus oxygen in percentage. The respective plots of FIG. 2 are substantially identical regardless of whether the fire in burner 10 is of high intensity or low intensity. The measured peak amplitude of the radiation signal 3.35 microns shows a linear decrease of arbitrary units as the percentage oxygen increases in burner 10. The measured peak amplitude at 2.96 microns shows that the arbitrary units linearly increases as the percentage oxygen increases in burner 10. The ratio of the peak amplitudes of these two signals; i.e., 2.96/3.35, shows a steeper linear increase in arbitrary units versus a percentage increase of oxygen. It has been experimentally found that taking the ratio of these two signals has the effect of eliminating variables which are otherwise hard to measure; i.e., signal gain versus horizontal distance from the flame under conditions of variable intensity of the flame. Measuring the ratio also has the affect of increasing the overall sensitivity; i.e., the slope of the ratio line is steeper than the slope of either the 2.96 micron line or the 3.35 micron line.

There are several additional factors which indicate that the technique of infrared emittance analysis, by means of the foregoing ratioing measurement, provides a better combustion indicator than an oxygen flue gas analyzer and/or a carbon monoxide analyzer. Among these additional factors is the fact that the infrared emittance analysis technique spans the oxygen and carbon monoxide analyzer ranges, it provides a good stoichiometric indicator, it can be implemented at very low cost and requires less equipment than oxygen and/or carbon monoxide analyzers, it provides a self-calibrating procedure, it enables analysis of individual burners rather than requiring an average of multiple burners, it enables the selection of a constant setpoint, it provides a fast response time in the range of a relatively few seconds, and it is easy to install.

In operation, the potentiometer 88 is set at a predetermined constant value, as for example, at a 1 percent oxygen level. This setpoint will yield a predetermined orbit level which is observable from FIG. 2. Thereafter, the detector 24 continuously monitors the flame in burner 10, and the respective 2.96 micron signal and 3.35 micron signal are each processed via the electronic circuits hereinbefore described. The ratio of these measured signals is electronically calculated via the divisor circuit 80, and this ratio signal is compared against the constant value setpoint signal of potentiometer 88. If the ratio signal departs from the preselected setpoint, an error signal is developed by the summation circuit 90 to activate the PID 95, which in turn electromechanically varies the air damper 22 to adjust the fuel/air mixture fed into the burner 10. This adjustment causes a correction in the fuel/air mixture to return the measured radiation signals in the direction so as to reduce the error signal to zero.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. In particular, many of the circuit functions described herein may be in practical application incorporated into a micro controller of the type described earlier, wherein the micro controller is properly programmed to provide an output signal representation of the functions described.

What is claimed is:

1. An infrared emittance combustion analyzer for monitoring a flame of a burner and thereby controlling the combustion efficiency by adjusting the fuel/air mixture into the burner, comprising:

a) a pair of optical sensors mounted in a position to monitor said burner flame, each of said optical sensors being responsive to radiation signals at a predetermined wavelength;

b) a high pass filter connected to each of said optical sensors, each said high pass filter having means for blocking DC radiation signal components;

c) a rectifier and filter circuit connected to each of said high pass filters, each said rectifier and filter circuit having means for providing a DC signal representative of the respective signals received from each said high pass filters;

d) means for forming the ratio of said respective DC signals;

e) a manually operated DC setpoint circuit having means for providing a DC setpoint signal;

f) a difference circuit connected to said manually operated DC setpoint circuit and to said means for forming the ratio, said difference circuit having an output for providing an error signal and means for generating said error signal as representative of the difference between said ratio and said DC setpoint signal; and g) a controller connected to receive said error signal and having means for adjusting the fuel/air mixture into the burner in response thereto.

2. The analyzer of claim 1, wherein said pair of optical sensors are respectively responsive to a wavelength of 2.96 microns and 3.35 microns.

3. The analyzer of claim 1, wherein said high pass filter passes frequencies at 30 Hertz.

4. The analyzer of claim 1, wherein said means for adjusting the fuel/air mixture further comprises an air damper.

5. The analyzer of claim 1, wherein said pair of optical sensors further comprise a detector housing having mounted therein a pair of PbSe sensors.

* * * * *